US005606963A

United States Patent [19]

Wenzel et al.

[11] Patent Number: 5,606,963

[45] Date of Patent: Mar. 4, 1997

[54] ATTACHMENT DEVICE TO SECURE CABLE ENDS OF A COMPOUND ARCHERY BOW

[76] Inventors: Paul J. Wenzel, S-2120 Paddock La., Finksburg, Md. 21048; Ronald E. Casey, 519 Hawthorne Rd., Linthicum, Md. 21090

[21] Appl. No.: 350,417

[22] Filed: Dec. 6, 1994

[51] Int. Cl.[6] ..... F41B 5/14

[52] U.S. Cl. ..... 124/86; 124/25.6

[58] Field of Search ..... 124/23.1, 25.6, 124/86, 900; 24/68 R, 71.1; 403/291, 300, 362

[56] References Cited

U.S. PATENT DOCUMENTS

| | | | |
|---|---|---|---|
| 3,183,565 | 5/1965 | Schwarz | 24/71.1 |
| 4,336,786 | 6/1982 | Mannon et al. | 124/25.6 X |
| 4,440,142 | 4/1984 | Simonds | 124/25.6 |
| 4,440,143 | 4/1984 | Nishioka | 124/25.6 |
| 4,448,183 | 5/1984 | Quartino et al. | 124/25.6 |
| 4,733,648 | 3/1988 | Martin | 124/86 |
| 4,781,167 | 11/1988 | Martin | 124/25.6 |
| 5,125,389 | 6/1992 | Paff | 124/86 |
| 5,307,787 | 5/1994 | La Borde et al. | 124/25.6 |
| 5,381,777 | 1/1995 | Mitchell et al. | 124/25.6 |

FOREIGN PATENT DOCUMENTS

| | | | |
|---|---|---|---|
| 669133 | 6/1979 | U.S.S.R. | 24/68 R |

*Primary Examiner*—John A. Ricci

[57] ABSTRACT

An improved attachment device to adjustably secure looped cable ends of a compound archery bow, either steel cables or synthetic fiber cables, to the tips of the bow limbs. The device comprising a base element, two parallel walls attached to the top surface of the base element defining a slot therebetween, each wall having an aligned aperture to receive a limb tip axle to secure the device to the limb tips, a cable support element received within the slot and slidable therewithin and adapted to receive the looped ends of the cables, a threaded bore through said base element from the top surface to the bottom surface to receive a threaded adjusting member which can be adjusted upward from the top surface of said base element to bear against a lower surface of said cable support element. The adjusting member used to adjust the distance between the cable support element and the axle mounting aperture and adjust the effective length of the bow cable. The device is suitable for both original equipment manufacture (OEM) and after market applications.

12 Claims, 4 Drawing Sheets

VIEW A - A

VIEW A - A

ATTACHMENT DEVICE TO SECURE CABLE ENDS OF A COMPOUND ARCHERY BOW

BACKGROUND AND SUMMARY

Compound archery bows use eccentric wheels or cams (either two wheels or two cams) along with connecting cables and a bow string to control the force required to draw the bow and store energy in the bow limbs. An eccentric wheel or cam is mounted to each bow limb tip and a cable connects each wheel or cam to the opposite limb tip. The bow string connects the two wheels or cams together and provides the means to draw the bow and propel the arrow. The stored energy is used to propel the arrow when the archer releases the bow string. To achieve peak or maximum performance from the bow, the two eccentric wheels or cams must be synchronized to rotate at the same rate and the same amount during the draw and after release. Synchronization is achieved by setting the cables to the correct lengths. The attachment device that is the subject of this invention will allow the cables to be conveniently and precisely adjusted to synchronize the wheel or cam rotation.

Existing patents found relating to the subject of this patent application:

| | | |
|---|---|---|
| U.S. Pat. 3,183,565 | May 18, 1965 | Schwarz |
| U.S. Pat. 4,336,786 | June 29, 1982 | Mannon et al. |
| U.S. Pat. 4,370,972 | February 1, 1983 | Stewart et al. |
| U.S. Pat. 4,440,142 | April 3, 1984 | Simonds |
| U.S. Pat. 4,440,143 | April 3, 1984 | Nishioka |
| U.S. Pat. 4,448,183 | May 15, 1984 | Quartino et al. |
| U.S. Pat. 4,733,648 | March 29, 1988 | Martin |
| U.S. Pat. 4,781,167 | November 1, 1988 | Martin |
| U.S. Pat. 5,125,389 | June 30, 1992 | Parr |
| U.S. Pat. 5,307,787 | May 3, 1994 | LaBorde et al. |
| U.S. Pat. 5,381,777 | January 17, 1995 | Mitchell et al. |

U.S. Pat. Nos. 4,336,786 to Mannon et al. and 4,370,972 to Stewart et al. are for attachment members that secure the ends of the compound bow cables by means of a circuitous pathway and a means of locking the cable in place by a lock screw that provides perpendicular pressure on the cable to displace a portion of that cable into a concavity to provide a firm crimp. The locking action deforms the cable which causes two disadvantages. First, the deformed cable may not freely pass through the attachment member passageways to allow further adjustment; second, the deformation, especially multiple deformation as could occur during adjustment of a bow for peak performance, would weaken the cable increasing the probability of subsequent failure.

U.S. Pat. Nos. 4,440,142 to Simonds and 4,733,648 to Martin provide means to anchor the cable ends to the limb tips of compound bows through the use of a cable loop and without infinite adjustment. Further, the device of Martin, U.S. Pat. No. 4,733,648 includes a locking means that deforms the cable end making subsequent cable length adjustment impractical.

Further, the adjustment of the cables in the attachment members of the above patents requires that cable tension be removed during adjustment. The disadvantage is that adjustment becomes a time consuming, tedious procedure of trial and error activity, in which the cables are adjusted with the tension relieved by adjusting the limb stress or, more likely, by a tool for that purpose, and then the bow is checked for proper adjustment after the tension is reapplied.

Further, the attachment members of the above patents are usable only with steel cables. Many current compound bows use synthetic fiber cables which cannot be attached by those members.

U.S. Pat. Nos. 4,440,143 to Nishioka and 4,448,182 to Quartino et al. show cable attachment devices that use screw adjusters connected to the bow limbs. These require that the cable ends be terminated in special mechanisms to attach to the limbs. U.S. Pat. No. 4,448,182 to Quartino et al. also describes a bracket element that connects to the limb tip axles by means of a cable loop permanently connected to the bracket. Said bracket also requires the cable end be terminated in a special mechanism.

U.S. Pat. No. 4,781,167 to Martin describes an adjustable anchor to secure the ends of the tension cable to the limb tips of a compound bow. The device described requires a cable loop to attach the device to the limb tip axle on both sides of the eccentric wheel or cam, rather than the a single device of the invention disclosed in this application.

U.S. Pat. Nos. 5,125,389 to Paff and 3,183,565 to Schwarz describe mid line adjusters that are usable for tensioning devices temporarily mounted to a compound bow for maintenance purposes. These patents are not directly related to the invention described in this application.

U.S. Pat. No. 5,307,787 to LaBorde describes an anchor bracket that adjusts the position of the end of the compound bow cable parallel to the limb tip axle for the purpose of adjusting limb tip torque. Said anchor bracket does not provide for any adjustment of the effective cable length.

U.S. Pat. No. 5,381,777 to Mitchell et al. describes a yoke mechanism that attaches to the limb tip axle on both sides of the compound bow eccentric wheel or cam by means of two mounting brackets and two cable end segments. The yoke assembly requires that the cable end segments and the end of the tension cable be terminated in a mechanism or element to hold said cable ends in the yoke assembly. The yoke assembly described comprises several elements and is relatively complex.

The attachment device of the invention which is the subject of this application holds the cable end loops commonly employed in compound bows without deformation and with no added stress. The attachment device is designed to hold the looped ends of either steel cables or cables of synthetic fibers. The attachment device can be adjusted with the compound bow cables under tension, which will allow the bow mechanic or archer to conveniently and precisely adjust the cable lengths to achieve peak bow performance without affecting other bow adjustments and without tools to relieve the cable tension.

This invention relates generally to archery bows and particularly to an improved attachment device for securing the ends of the cables in a compound bow using dual eccentric wheels or cams. The present invention is especially adapted for use on compound bows wherein the terminal ends of the eccentric wheel or cam cables are intended to be anchored in the area of the bow limb tips adjacent to the opposite eccentric wheel or cam. Such bows commonly have two such eccentric wheels or cams and possible additional idler wheels about which the cables pass. Unless the bow cable rigging includes a yoke harness or yoke device, one of the most common methods of attaching the cable terminal end to the limb tips has been to form a loop in the terminal end of the cable and place that loop over a grooved spacer around the eccentric axle adjacent to the eccentric wheel or cam. For a steel cable the loop is formed by folding the distal end of the cable back on itself and attaching that end to the same cable by means of a crimped fastener. For a synthetic fiber cable the loop is naturally formed by the method of manufacture from a continuous loop of several strands of small diameter fibers. The end loop is formed by wrapping the strands with fiber serving to hold the strands together and protect them from abrasion. With either steel or synthetic fiber cables the grooved spacer holds the end loop in place but provides no means of adjustment.

Those familiar with the workings of a compound archery bow understand that the proper rigging of the bow with cables and bowstring is critical to the bow performance. Specifically the rigging must place the bow limbs under the correct range of stress and provide the correct balance or synchronization of the eccentric wheels or cams. The wheels or cams must rotate at the same rate as the string is pulled during the archer's drawing the bow, and as the string, wheels or cams and cables return to the rest position as the arrow is propelled forward after the string is released to shoot the arrow. The present invention provides an attachment member to accept the terminal end loop of each of the eccentric wheel or cam cables and connect them to the wheel or cam axles in such a way that the effective cable lengths can be easily adjusted at any point in the drawing of the bow even by an archer in the field. Correct adjustment of the effective cable lengths will result in the synchronization of the two eccentric wheels or cams and peak performance from the bow.

The attachment device consists of three pieces: a body comprising a base element, having two parallel walls attached to said base element defining a slot therebetween to accept and confine the terminal loop of the wheel or cam cable. Near the upper end of each of the parallel walls, said walls have aligned apertures to receive the limb tip axle and thus connect the device to the limb tip. A cable loop support element shaped to support the loop under tension without damaging stress and a threaded adjustment element to adjust the effective cable length. A means of locking the adjustment element in place when properly adjusted is also provided, however different means of locking may be utilized. The device body is relatively thin allowing it to connect to the wheel or cam axle adjacent to the wheel or cam within the space typically allotted for the connection of the cable loop on a grooved spacer. All elements of the attachment device are symmetrical to allow the same device to be used to connect the cable loop at both bow limb tips.

One object of the current invention is to provide an improved compound archery bow cable attachment device to allow convenient adjustment of the effective cable length to synchronize the rotation of the bow eccentric wheel or cams.

Another object of the current invention is to provide an improved compound archery bow cable attachment device to accept either steel cable loops or synthetic fiber cable loops and effectively connect either type of cable to the bow limb tips.

Another object of the current invention is to provide an improved compound archery bow cable attachment device with symmetrical design to allow the same device to be used at both bow limb tips to attach alternate cable ends to the respective limb tips.

Another object of the current invention is to provide an improved compound archery bow cable attachment device of such dimensions as to allow it to replace the grooved spacer used to attach cable ends on many current compound bows so the adjustment feature can be added to bows currently without such convenient adjustment.

With these and other objects in view which will more readily appear as the nature of the invention is better understood, the invention consists in the novel construction, combination and arrangement of parts herein-after more fully described, illustrated and claimed.

BRIEF DESCRIPTION OF THE DRAWINGS

Included are four (4) sheets of drawings, containing nine (9) figures which show the attachment device in detail and how it is used on a compound archery bow.

Each individual part is designated by a single reference designator throughout all figures.

DETAILED DESCRIPTION OF THE INVENTION

Figure 1:
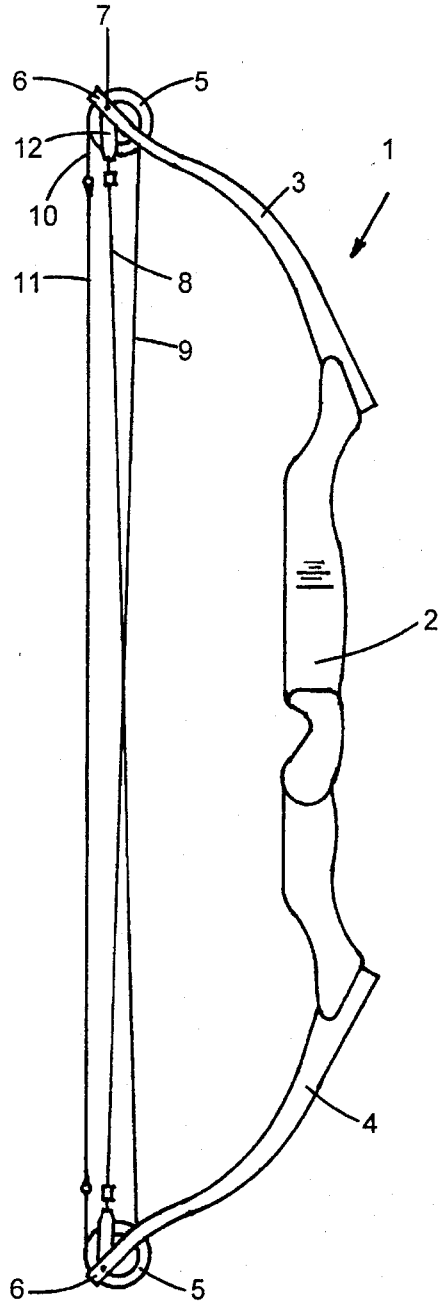
FIG. 1 is a side elevation of a typical dual eccentric compound archery bow using the cable end attachment device of the present invention.
Figure 2:
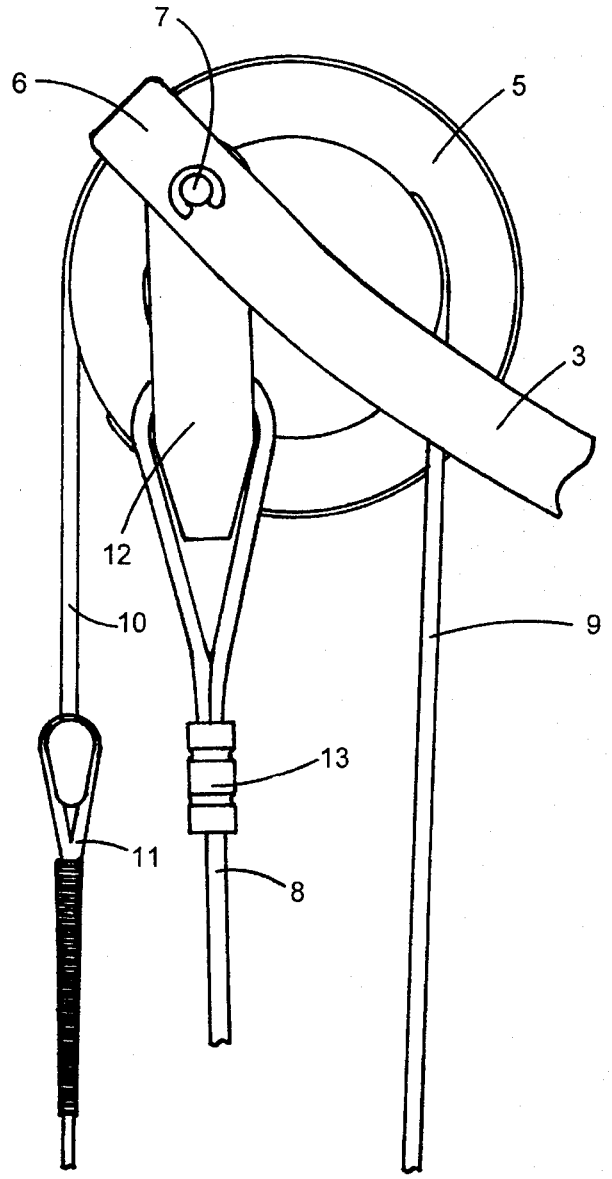
FIG. 2 is an enlarged view of a partial side elevation of the limb tip area of a compound archery bow of the type shown in FIG. 1.

Referring to FIG. 1, the present invention (an improved cable end attachment device) is applicable to a compound archery bow of the type shown in FIG. 1, designated 1, having a central handle or riser 2, two limbs 3 and 4 extending from the handle and dual eccentric wheels or cams 5—5 mounted to the limb tips 6—6. Such a bow may have any number of additional idler wheels or pulleys about which the cables pass, but will have a pair of eccentric wheels or cams appropriately mounted one each to the top and bottom limb tips as shown in FIGS. 1 and 2. The figures show the eccentric wheels or cams and the cable end attachment devices mounted in the central grooves formed in the limb tips (commonly referred to as split limb tips). It is understood that the present invention is equally applicable to alternate mounting arrangements such as brackets attached to the limb tips by means of fasteners or adhesives or brackets formed or molded in during limb manufacture. It will be appreciated that the cable end attachment device proposed by this invention may be practiced in combination with numerous types of archery bows and therefore the illustrated bow is merely exemplary since the essence of the invention resides in the unique cable end attachment device 12 which is used to adjustably secure both the first cable end 8 and the second cable end 9 to the two limb tips 6—6.

Figure 3:
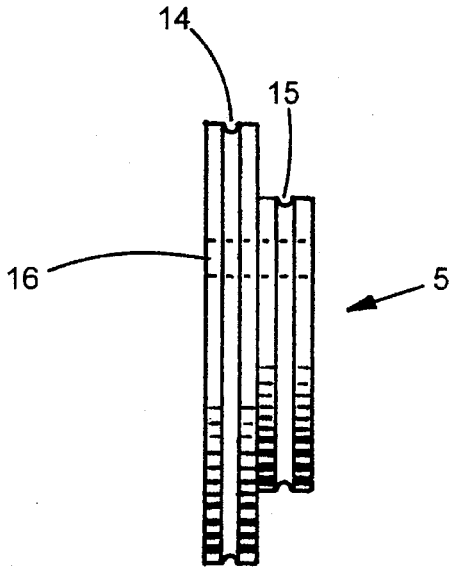
FIG. 3 is a rear elevation of a typical eccentric wheel or cam.

FIG. 3 shows a typical eccentric wheel or cam 5 with the string track 14, the cable track 15 and the eccentrically located pivot bore 16.

Figure 4:
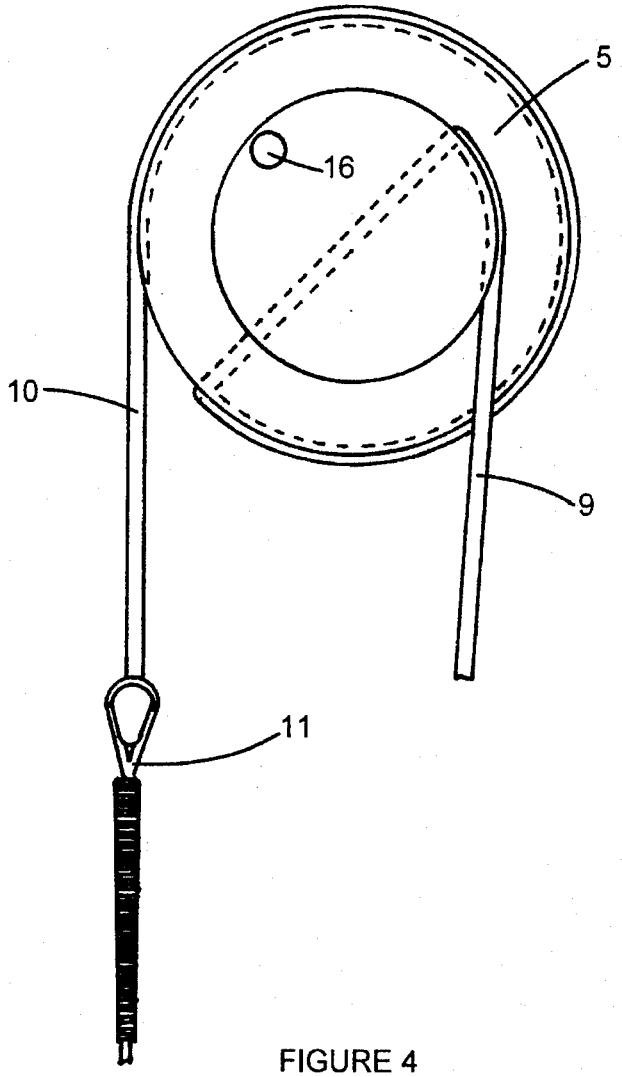
FIG. 4 is a side elevation of a typical eccentric wheel or cam showing a typical routing of a steel cable through and around the eccentric tracks.

FIG. 4 shows the same type of eccentric wheel or cam and a typical cable route through and around the wheel or cam. The cable 9 passes over a portion of the cable track 15 and through holes in the wheel or cam to become the string end of the cable 10. The string end of the cable follows the string track around the wheel or cam and attaches to the bowstring 11. This is a typical path for a steel cable and establishes an effective specific attachment point for the cable to the eccentric wheel or cam at the point where the cable 9 bends and passes through the wheel or cam. The bow string 11 also has an effectively fixed relationship to the eccentric wheel or cam through the fixed length of the string end of the cable 10. With these effectively fixed attachments there is also a fixed relationship between the bowstring and cable as the eccentric wheel or cam rotates about the pivot bore. Bows using the synthetic cables will have the cable 9 pass over a portion of the cable track and attach directly to the eccentric wheel or cam. The bowstring 11 on a bow using synthetic cables will also connect directly to the eccentric wheel or cam eliminating the need for a string end of the cable 10. Thus with a bow using synthetic cables there is also specific attachment points for the cable and bowstring and a fixed relationship between them as the eccentric wheel or cam rotates.

Referring again to FIGS. 1 and 2 the eccentric wheels or cams 5—5 are mounted to the top and bottom limb tips 6—6 by the pivot axles 7—7 such that the top cable 9 is anchored to the bottom limb tip 6 by the bottom attachment device 12 and the bottom cable 8 is attached to the top limb tip 6 by the top attachment device 12. FIG. 2 shows that the terminal end of cable 8 connects to the attachment device by a loop formed in the terminal end of the cable. For a steel cable the loop is formed by folding the distal end of the cable back upon itself and attaching that end to that same cable by means of the crimped fastener 13. For a synthetic cable the loop is formed by the means of manufacturing the cable from a continuous loop of several strands of small diameter fibers. The synthetic cable terminal end loop is formed and wrapped by a serving material to hold the loop in place and protect against abrasion. The bow string 11 connects the top and bottom string ends 10—10 together. This arrangement of bowstring, cables, and eccentric wheels or cams establishes bending stress on the bow limbs and sets the initial or at rest rotation for the two eccentric wheels or cams.

As the bowstring 11 is pulled the eccentric wheels or cams are caused to rotate to let out the bowstring or the string end of the cable 10 and take up the cables 8 and 9. The cables through the attachment devices 12—12 increase the bending stress on the bow limbs to store energy. When the bowstring is released the limbs return to the rest position providing the stored energy to propel the arrow forward.

As will be appreciated by those familiar with the mechanical principles in general and those principles at work in the compound archery bow in particular, peak performance of the bow requires that both eccentric wheels or cams rotate in synchronism during the draw and as they return to the rest position while propelling the arrow forward. Observation of the FIGS. 1 and 2 will show that the effective lengths of the cables 8 and 9 from their respective attachment points on the eccentric wheels or cams to the opposite limb tips establishes the at rest and dynamic timing of each eccentric wheel or cam. To correctly synchronize the eccentric wheel or cam timing, a means of adjusting that effective length is required. The improved attachment device proposed by the invention provides that means of adjustment in a convenient manner.

Figure 5:
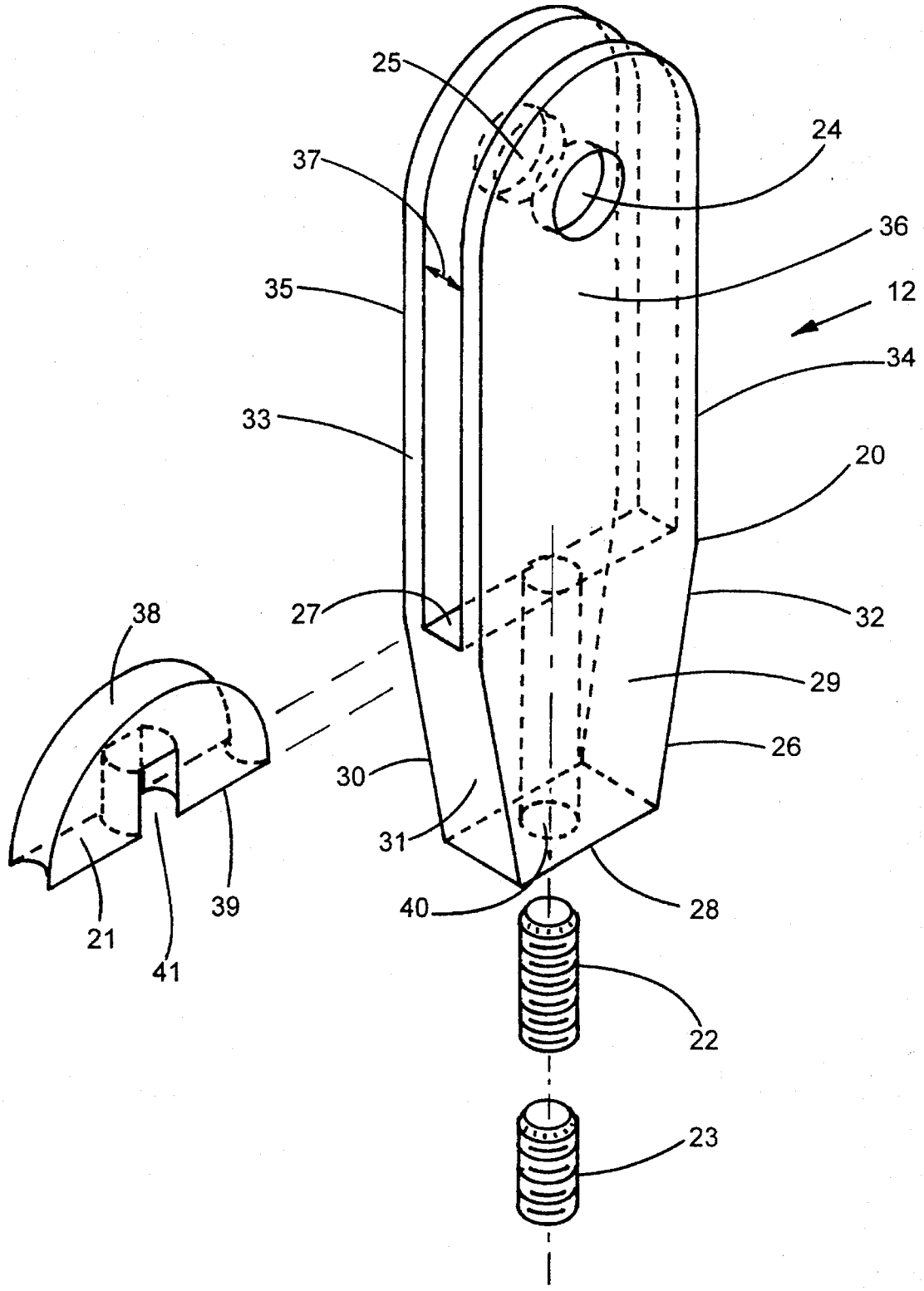
FIG. 5 is a perspective view of the cable end attachment device.

FIG. 5 shows the details of the improved attachment device and a locking element. The device body 20 comprises a base element 26 having a top surface 27, a bottom surface 28, a front surface 29, a rear surface 30, a left surface 31 and a right surface 32 with two parallel walls 33 and 34 attached to the top surface of the base element, one wall 33 having an outer surface 35 contiguous with the rear surface 30 of the base element and the other wall 34 having an outer surface 36 contiguous with the front surface 29 of the base element. The parallel walls extend upward from said base element and define a slot 37 between said walls. Near the upper end of the each of the walls, said walls 33 and 34 have aligned apertures 24 and 25 to receive the wheel or cam axle and connect the device to the limb tips. The cable support element 21 is received within the slot 37 and is slidable therewithin to adjustably support the end loop of a compound bow cable. Said cable support element 21 has a generally flat lower surface 39 and a generally arcuate upper surface 38 adapted to receive and support the said looped end of a compound bow cable. The device body base element 26 includes a means to adjust the position of the cable support element 21 within the slot 37. Said means consisting of a threaded bore 40 through said base element from the top surface 27 to the bottom surface 28 thereof and a threaded adjusting element 22 received in said threaded bore. Said adjusting element 22 can be adjusted to extend upward from the top surface 27 of the body base element 26 to bear against the lower surface 39 of the cable support element 21 to adjust the distance between the top surface 27 of the base element and the cable support element. Said adjustment controls the distance between the top surface of the cable support element 38 and the axle mounting aperture, and controls the effective length of the compound bow cable. The cable support element 21 also includes a blind bore 41 extending upward from the lower surface 39 of said cable support element. Said blind bore receives the top end portion of said adjusting element 22. The improved attachment device may further include a threaded locking element 23 received in threaded bore 40 below the threaded adjusting element 22 to lock said threaded adjusting element from rotating. Alternate means of locking may also be used such as a self locking thread on the adjusting element 22. The locking element 23 is merely exemplary as the essence of the invention resides in the novel cable end attachment device 12 which is used to adjustably anchor one or both of the first and second cable ends 8 and 9 to their respectively opposite limb tips 6—6 and is not dependent on the exact means of locking.

Figure 6:
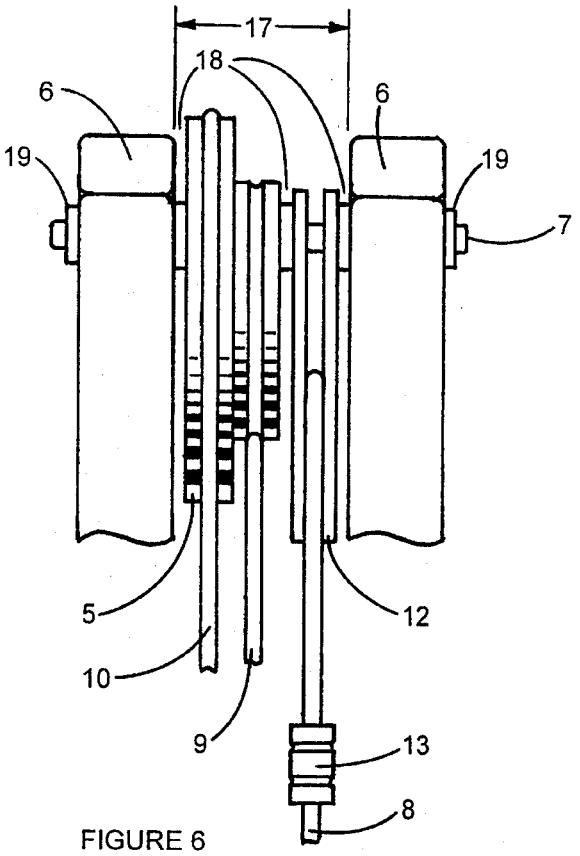
FIG. 6 is a partial rear elevation of the limb tip area of a compound archery bow of the type shown in FIG. 1 with the eccentric wheel or cam and the cable end attachment device mounted to the limb tip.

FIG. 6 is a partial view of the top limb tip 6 from the typical bow 1 showing the eccentric wheel or cam 5 and the attachment device 12 connected to the split limb tip 6 by axle 7. Although not shown in FIG. 6, the top eccentric wheel or cam cable connects to the bottom limb tip 6 via the bottom attachment device 12 as shown in FIG. 1, and the top cable string end 10 connects to the bowstring. The top cable end attachment device 12 connects the loop formed at the end of the cable 8 by the crimp fastener 13 to the top axle 7. The total width of the attachment device is relatively thin allowing it to be mounted within the eccentric wheel or cam groove 17 formed in the split limb tips in the typical archery compound bow. Spacers or washers 18 are typically used to separate the eccentric wheels or cams and the cable end attachment device from each other and the sides of the groove in the limb tip. The pivot axle 7 may be retained by snap rings 19, or similar devices, it may be retained by a press fit in the limb tips or by some other means. Since the cable end attachment device is relatively thin it is readily adaptable to current compound archery bow manufacture with minor change in bow manufacture procedures. It is also readily adaptable to after market applications by archery pro shops, archery bow mechanics and knowledgeable compound bow owners. All that is required is to shorten the nominal cable length to account for the effective length of the cable end attachment device.

Figure 7:
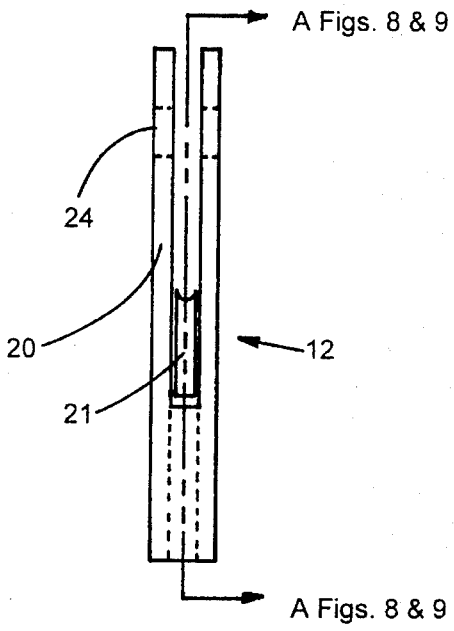
FIG. 7 is a rear elevation of the cable end attachment device showing the section A—A to be seen in FIGS. 8 and 9.
Figure 8:
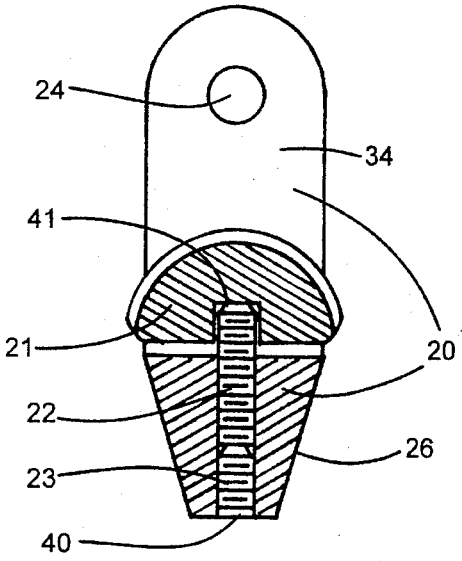
FIG. 8 shows the sectional view A—A from FIG. 7.
Figure 9:
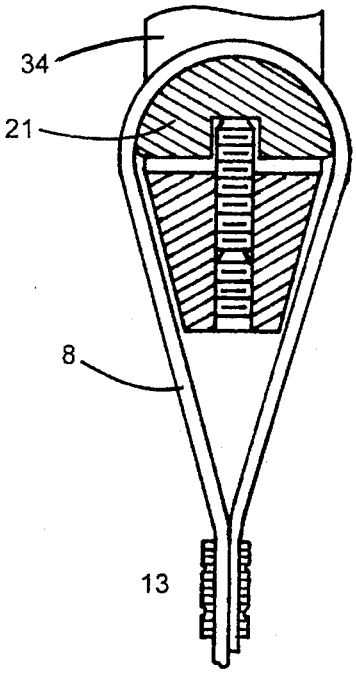
FIG. 9 is a view similar to FIG. 8 with the cable end loop added.

FIGS. 7, 8, and 9 show the details of the improved cable end attachment device through the use of sectional views. FIG. 7 shows the section A—A which is shown in FIGS. 8 and 9. In FIG. 8 the relationship between elements is clearly shown. The sectional view A—A shows the section of body 20 comprising the base element 26 and one wall 34. Cable support element 21 is confined in the slot between the walls 34, shown, and 33, not shown. The adjustment element 22 and locking element 23 are threaded into threaded bore 40. The adjustment element 22 supports the cable support element 21 within the blind bore 41 and adjusts the distance between it and the axle mounting apertures 24, shown, and 25 not shown. The locking set screw 23 is one means of locking the adjustment element 22 in place after adjustment. FIG. 9 is similar to FIG. 8 but adds the view of the terminal loop at the end of cable 8 to clearly show how the cable support element 21 supports the cable loop and how the slot formed between the walls 34, shown, and 33, not shown, confines the loop.

From the foregoing it will be seen that an improved manner of attaching compound archery bow cable ends has been presented which provides positive and secure connection of the cable ends to the bow limb tips in such a way as to allow adjustment of the effective cable length to synchronize the timing of the bow eccentric wheels or cams to obtain peak performance from the bow. In addition, the attachment device is symmetrical and can be used at both ends of the bow. Further the attachment device is relatively thin and can be used with current bow limb and eccentric wheel or cam designs without modification and can be used to retrofit many currently owned bows by knowledgeable persons.

We claim:

1. A device for securing a cable end to a limb tip in a compound archery bow comprising:

a base element having a top surface, a bottom surface, a front surface, a rear surface, a left surface and a right surface;

two parallel walls attached to the top surface of the base element, one wall having an outer surface contiguous with the rear surface of the base element, the other wall having an outer surface contiguous with the front surface of the base element, the parallel walls extending upward from the top surface of the base element and defining a slot therebetween, near their upper ends, each wall has an aligned aperture adapted to receive an axle at a compound bow-limb tip;

a cable support element received within said slot and slidable therewithin, said cable support element adapted to receive an end of a cable of said compound bow;

means to fixedly adjust the location of the cable support element within the slot, thus adjusting the distance between the end of said cable and said axle.

2. The device of claim 1, in which the cable support element has a generally arcuate upper surface and a generally flat lower surface, The upper surface adapted to receive a looped end of said cable.

3. The device of claim 2, in which the means to adjust the location of the cable support element includes;

a threaded bore through said base element from the top surface to the bottom surface thereof;

a threaded adjusting member received in said threaded bore, which can be adjusted to extend upward from said top surface and bear against said lower surface of said cable support element to adjust the distance between the top surface of the base element and the cable support element.

4. The device of claim 2, in which said cable support element includes a blind bore extending upward from said lower surface which receives a top end portion of said threaded adjusting member.

5. The device of claim 2, further including a threaded lock member received in said threaded bore below said threaded adjusting member to lock said threaded adjusting member from rotation.

6. The device of claim 1, in which the means to adjust the location of the cable support element includes:

a threaded bore through said base element from the top surface to the bottom surface thereof;

a threaded adjusting member received in said threaded bore, which can be adjusted to extend upward from said top surface and bear against said lower surface of said cable support element to adjust the distance between the top surface of the base element and the cable support element.

7. In a compound archery bow including a handle, upper and lower limbs connected to the handle, eccentric wheels or cams mounted on pivot axles mounted at the tips of the limbs, and cables passing around or attached to said wheels or cams and having terminal ends attached to respective opposite limb tips, the improvement wherein the bow is provided with a device for securing at least one cable end to a limb tip, comprising:

a base element having a top surface, a bottom surface, a front surface, a rear surface, a left surface and a right surface;

two parallel walls attached to the top surface of the base element, one wall having an outer surface contiguous with the rear surface of the base element, the other wall having an outer surface contiguous with the front surface of the base element, the parallel walls extending upward from the top surface of the base element and defining a slot therebetween, near their upper ends, each wall has an aligned aperture adapted to receive an axle at a compound bow limb tip;

a cable support element received within said slot and slidable therewithin, said cable support element adapted to receive an end of a cable of said compound bow;

means to fixedly adjust the location of the cable support element within the slot, thus adjusting the distance between the end of said cable and said axle.

8. The improvement in an archery bow of claim 7, in which the cable support element has a generally arcuate upper surface and a generally flat lower surface. The upper surface adapted to receive a looped end of said cable.

9. The improvement in an archery bow of claim 8, in which the means to adjust the location of the cable support element includes;

a threaded bore through said base element from the top surface to the bottom surface thereof;

a threaded adjusting member received in said threaded bore, which can be adjusted to extend upward from said top surface and bear against said lower surface of said cable support element to adjust the distance between the top surface of the base element and the cable support element.

10. The improvement in an archery bow of claim 8, in which said cable support element includes a blind bore extending upward from said lower surface which receives a top end portion of said threaded adjusting member.

11. The improvement in an archery bow of claim 8, further including a threaded lock member received in said threaded bore below said threaded adjusting member to lock said threaded adjusting member from rotation.

12. The improvement in an archery bow of claim 7, in which the means to adjust the location of the cable support element includes:

a threaded bore through said base element from the top surface to the bottom surface thereof;

a threaded adjusting member received in said threaded bore, which can be adjusted to extend upward from said top surface and bear against said lower surface of said cable support element to adjust the distance between the top surface of the base element and the cable support element.

* * * * *